US006146234A

United States Patent [19]

Yang

[11] Patent Number: 6,146,234

[45] Date of Patent: Nov. 14, 2000

[54] ASCENDING/DESCENDING MECHANISM

[75] Inventor: Shin-Ya Yang, Hsin Tien, Taiwan

[73] Assignee: Ya Yung Enterprise Co., Ltd., Taipei Hsien, Taiwan

[21] Appl. No.: 09/373,023

[22] Filed: Aug. 11, 1999

[51] Int. Cl.[7] ..... A63H 13/20; A63H 29/00; A63H 11/04

[52] U.S. Cl. ..... 446/314; 446/238; 446/335; 446/352; 40/411; 40/415

[58] Field of Search ..... 446/238, 314, 446/353, 335, 338, 352, 354; 40/411, 415

[56] References Cited

U.S. PATENT DOCUMENTS

| | | | |
|---|---|---|---|
| 3,147,566 | 9/1964 | Ong | 446/354 |
| 4,622,020 | 11/1986 | Amici | 446/298 |
| 4,753,436 | 6/1988 | Sinclair | 272/31 |
| 4,864,879 | 9/1989 | Hou | 74/50 |
| 4,890,828 | 1/1990 | Hou | 272/31 |
| 4,939,944 | 7/1990 | Hou | 74/49 |
| 4,985,883 | 1/1991 | Hou | 369/69 |
| 5,412,889 | 5/1995 | Hou | 40/411 |
| 5,556,318 | 9/1996 | So | 446/236 |

*Primary Examiner*—Jacob K. Ackun
*Assistant Examiner*—Kevin Hughes
*Attorney, Agent, or Firm*—Pro-Techtor International Services

[57] ABSTRACT

An ascending/descending mechanism in which a face gear is rotated to drive two symmetrically arranged cylindrical gears, whereby two eccentric shafts fitted with the cylindrical gears are rotated in reverse directions. Two driven slide blocks are fitted with the short shafts of the eccentric shafts. The top ends of the driven slide blocks are fitted with two columns which are fitted in fitting holes of retaining blocks. When the cylindrical gears are reversely rotated, the short shafts of the eccentric shafts are slided within the slide slots of the driven slide blocks, whereby the columns are reciprocally moved up and down. Accordingly, the dolls or decorative articles at the top ends of the columns are alternately ascended or descended. The power source for driving the face gear can be a music bell or a motor, so that when the dolls or decorative articles at the top ends of the columns are alternately ascended or descended, a music or other audio/video effect is cooperatively created.

6 Claims, 4 Drawing Sheets

ASCENDING/DESCENDING MECHANISM

BACKGROUND OF THE INVENTION

The present invention relates to an ascending/descending mechanism which is able to make symmetrically arranged dolls or decorative articles alternately ascend or descend. The supporting structure and transmission structure of the ascending/descending mechanism are all symmetrically arranged so that they can be exchanged. In addition, the components of the ascending/descending mechanism are engaged with each other by means of projections and insertion holes so that the assembling procedure can be simplified and a great amount of small accessories such as screws, rivets, washers, etc. are saved. Therefore, the assembling efficiency is increased. Moreover, the components of the mechanism are all made of plastic materials so that the total weight of the mechanism is decreased and the load on the power source is reduced the reliability of the action is enhanced. In addition, since the components of the mechanism are all made of plastic materials, the components can be made by injection molding with one mold formed with multiple perforations so that the production efficiency is greatly increased.

The conventional ascending/descending mechanisms used in toys or decorative articles have specific structures in accordance with the selected power sources such as music bell or motor. The components of such ascending/descending mechanism are not unified and thus are not exchangeable. As a result, the development cost of these products are relatively high. Moreover, these ascending/descending mechanisms are assembled by means of a great amount of traditional accessories such as screws, rivets, washers, etc. Therefore, the assembling procedure is complicated and the connection between these accessories is hardly reliable. Once one of the parts is loosened or dropped, the function of the mechanism will be affected and the using life thereof will be shortened.

SUMMARY OF THE INVENTION

It is therefore a primary object of the present invention to provide an ascending/descending mechanism in which the supporting structure and transmission structure are all symmetrically arranged so that the components are exchangeable. In addition, the components of the ascending/descending mechanism are engaged with each other by means of projections and insertion holes so that the assembling procedure can be simplified and a great amount of small accessories such as screws, rivets, washers, etc. are saved. Therefore, the assembling efficiency is increased.

It is a further object of the present invention to provide the above ascending/descending mechanism in which the components are all made of plastic materials so that the total weight of the mechanism is decreased and the load on the power source is reduced the reliability of the action is enhanced. In addition, since the components of the mechanism are all made of plastic materials, the components can be made by injection molding with one mold formed with multiple perforations so that the production efficiency is greatly increased.

It is still a further object of the present invention to provide the above ascending/descending mechanism which has a modularized structure which can be combined with other decorative articles with different patterns in cooperation with different power sources.

The present invention can be best understood through the following description and accompanying drawings wherein:

DETAILED DESCRIPTION OF THE PREFERRED EMBODIMENT

Figure 1:
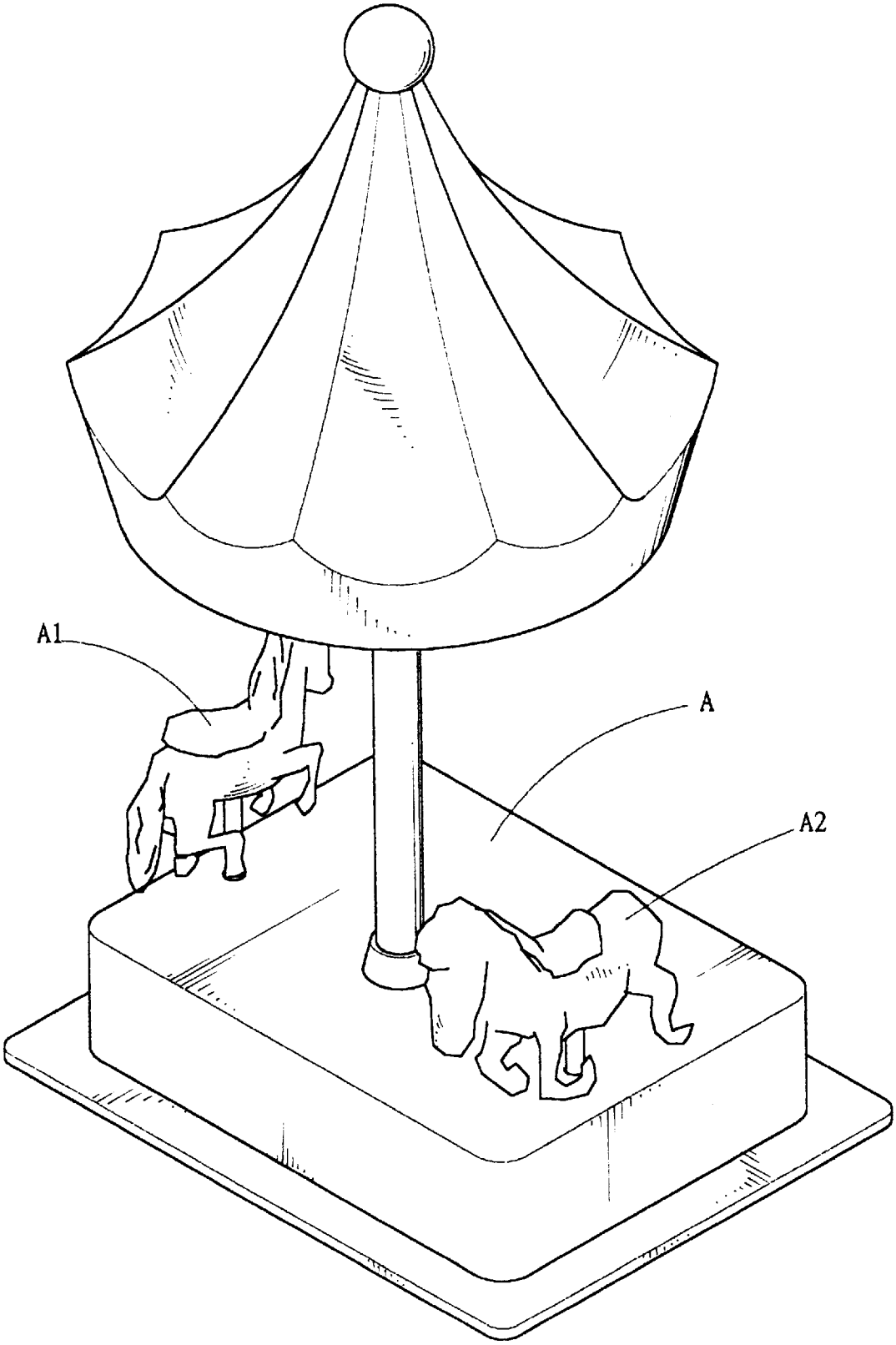
FIG. 1 is a perspective view showing that the ascending/descending mechanism of the present invention is applied to a carrousel.
Figure 2:
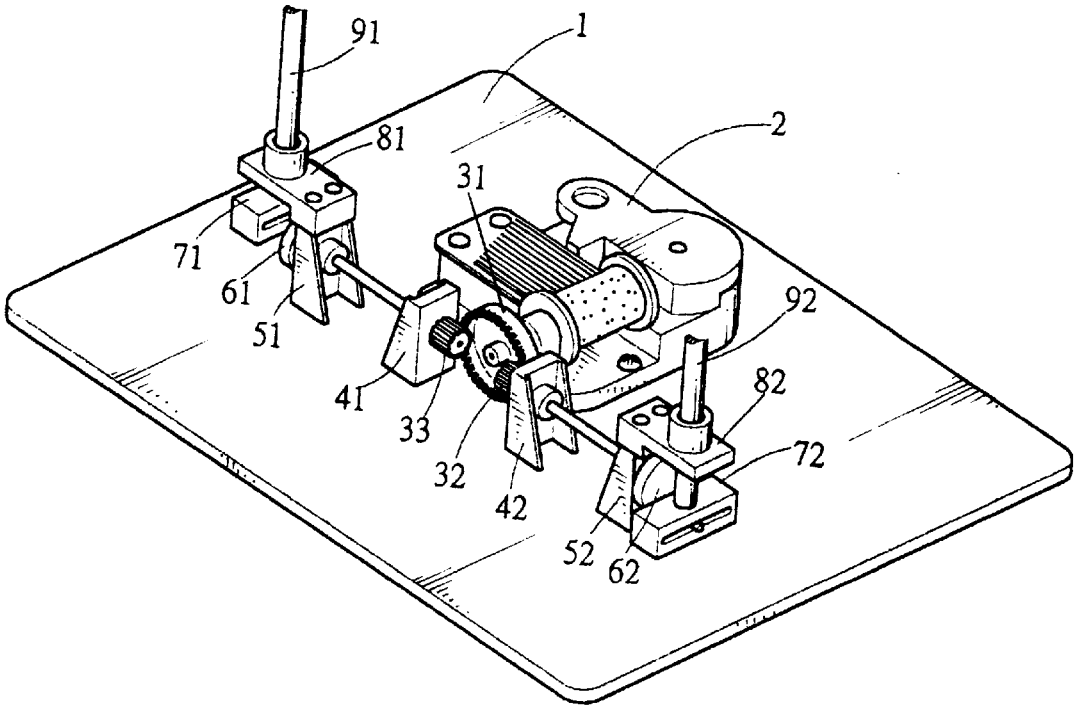
FIG. 2 is a perspective assembled view of a preferred embodiment of the present invention.
Figure 3:
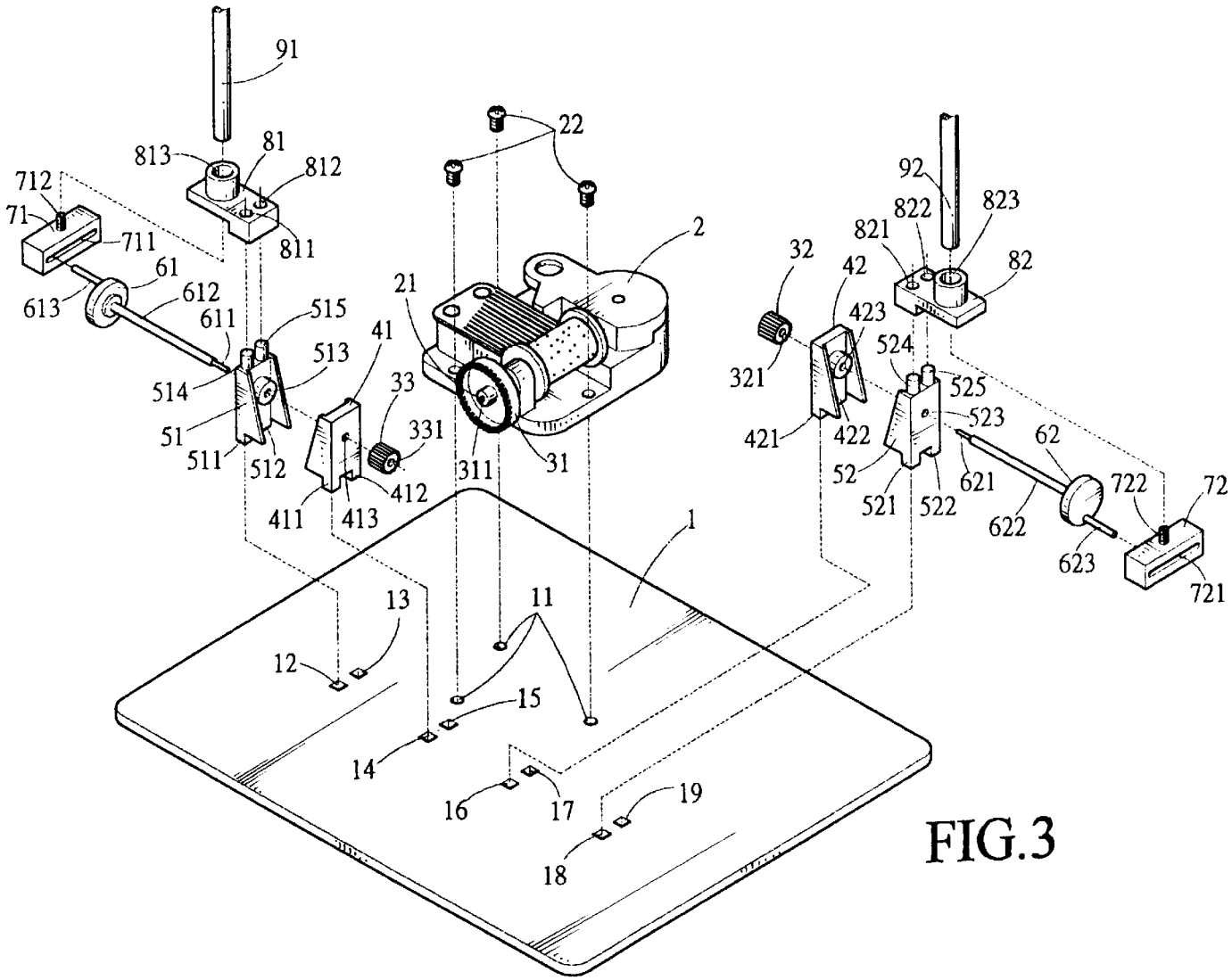
FIG. 3 is a perspective exploded view of a preferred embodiment of the present invention.

Please refer to FIG. 1. The ascending/descending mechanism A of the present invention is applied to a carrousel music bell. The ascending/descending mechanism serves to make the opposite toy horses A1 , A2 of the music bell alternately ascend and descend. Referring to FIGS. 2 and 3, the ascending/descending mechanism A of the present invention includes a base board 1 as a retainer. The base board 1 is formed with circular holes 11 and rectangular holes 12 to 19 for fixedly assembling the music bell 2 as a power source and inner supports 41, 42 and outer supports 51, 52 as parts for supporting a transmission mechanism. The transmission mechanism includes a face gear 31 having a central hole 311 in which a power output shaft 21 of the music bell 2 is tightly fitted. The inner supports 41, 42 have projections 411, 412 and projections 421, 422 at bottoms for fixedly inserting into the rectangular holes 14, 15 and 16, 17 of the base board 1. The outer supports 51, 52 have projections 511, 512 and projections 521, 522 at bottoms for fixedly inserting into the rectangular holes 11, 12 and 18, 19 of the base board 1. The inner and outer supports 41, 42 and 51, 52 are side by side symmetrically arranged on two sides of the face gear 31. The inner and outer supports 41, 42 and 51, 52 are respectively formed with shaft holes 413, 423 and 513, 523. The long shafts 612, 622 of two eccentric shafts 61, 62 are passed through the shaft holes 513, 413 and 523, 423 and supported between the inner and outer supports 41, 51 and 42, 52. The ends of the long shafts of the eccentric shafts 61, 62 are disposed with fitting shafts 611, 621 respectively fitted with two cylindrical gears 33, 32 meshing with the face gear 31. The short shafts 613, 623 of the eccentric shafts 61, 62 on the other sides thereof are respectively inserted into the slide slots 711, 721 of two driven slide blocks 71, 72. The top sections of the outer supports 51, 52 are respectively disposed with bosses 514, 515 and 524, 525 inserted into the insertion holes 811, 812 and 821, 822 of two retaining blocks 81, 82, whereby the retaining blocks 81, 82 are respectively fixed on the top ends of the outer supports 51, 52. Two columns 91, 92 are fitted into the fitting holes 812, 822 of the retaining blocks 81, 82 and locked with the thread rods 712, 722 formed on the driven slide blocks 71, 72.

Figure 4:
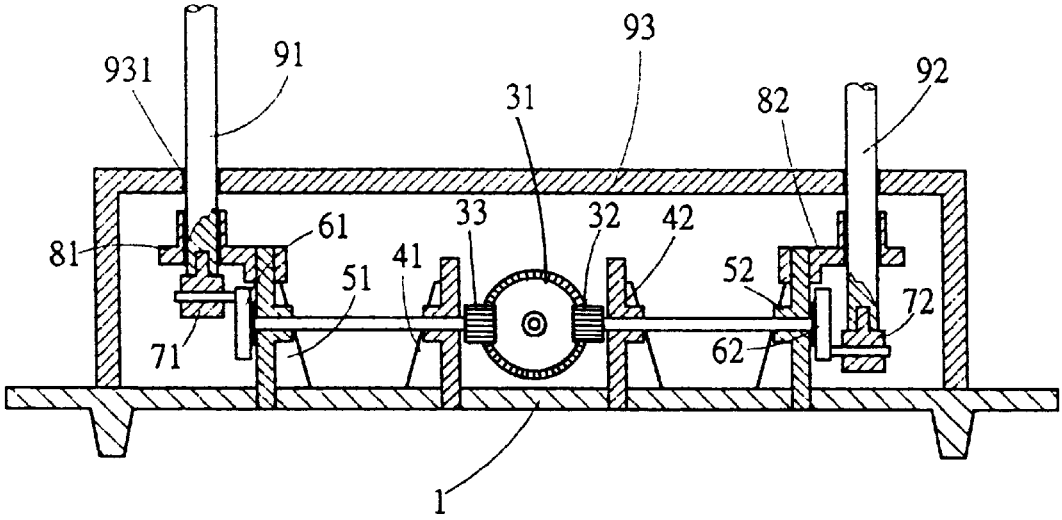
FIGS. 4 and 5 are sectional view showing the operation of the present invention.
Figure 5:
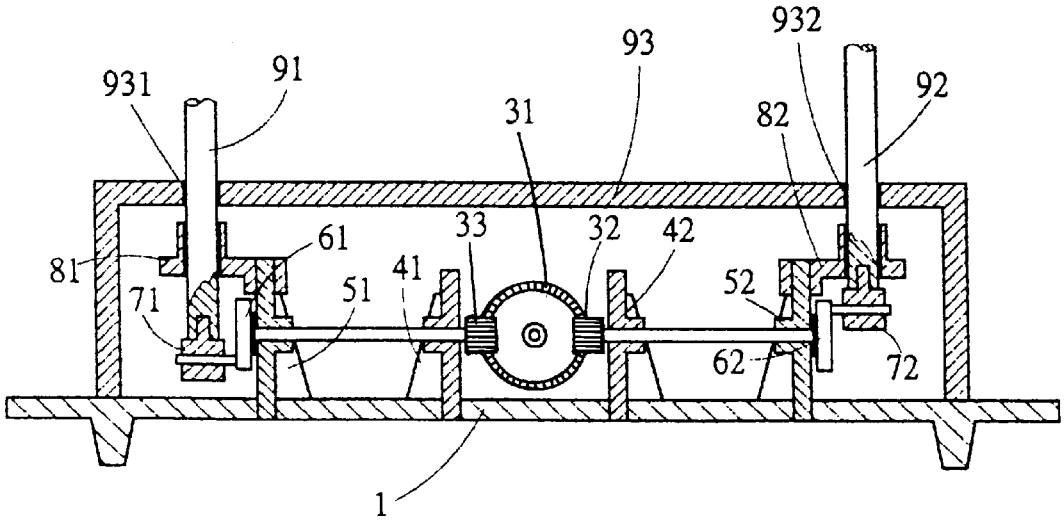

Please refer to FIGS. 4 and 5. The ascending/descending mechanism of the present invention is covered by an upper cover 93 formed with through holes 931, 932 through which the columns 91, 92 are passed. A doll or a decorative article can be mounted on each of the columns 91, 92 as necessary. When the face gear 31 is rotated, the cylindrical gears 33, 32 are driven by the face gear 31 to rotate the symmetrical eccentric shafts 61, 62 in reverse directions. At this time, the short shafts 613, 623 of the eccentric shafts 61, 62 are slided within the slide slots 711, 721 of the driven slide blocks 71, 72, whereby the columns 91, 92 are reciprocally moved up and down. Accordingly, the dolls or decorative articles at the top ends of the columns 91, 92 are alternately ascended or descended.

The supporting structures and transmission structures of the ascending/descending mechanism of the present invention are symmetrically arranged so that the components can be exchanged. Moreover, the components are engaged with each other by means of projections and insertion holes so that the assembling procedure can be simplified and a great amount of small accessories such as screws, rivets, washers, etc. are saved. Therefore, the assembling efficiency is increased.

The above embodiment is only used to illustrate the present invention, not intended to limit the scope thereof. Many modifications of the above embodiment can be made without departing from the spirit of the present invention.

What is claimed is:

1. An ascending/descending mechanism comprising:

a base board with a power source and a pair of inner supports and a pair of outer supports mounted thereon;

said power source with a power output shaft;

a supporting structure including said pair of inner supports and said pair of outer supports mounted on said base board, said inner and said outer supports are symmetrically arranged on two sides of said power output shaft of said power source, said inner and said outer supports are each formed with a shaft hole, top sections of each of said outer supports are disposed with bosses, said bosses are received in corresponding insertion holes of two retaining blocks, such that each of said two retaining blocks are fixed at a top end of a corresponding one of said outer supports; and a transmission structure including a face gear with a central hole that receives said power output shaft of said power source, long shafts of each of two eccentric shafts pass through said shaft holes of a corresponding one of said inner and a corresponding one of said outer supports and each said eccentric shaft is supported between a pair of said inner and outer supports, ends of said long shafts of each of said eccentric shafts include fitting shafts fitted with a cylindrical gear that meshes with said face gear, short shafts of each of said eccentric shafts are inserted into corresponding slide slots of two driven slide blocks, a column is passed through a fitting hole of each of said retaining blocks and is secured to a rod formed on each of said driven slide blocks.

2. The ascending/descending mechanism as claimed in claim 1, wherein:

said inner and said outer supports are connected to said base board by means of engagement between projections and insertion holes and each of said driven slide blocks are connected to a corresponding one of said columns by means of engagement between a boss and an insertion hole.

3. An ascending/descending mechanism as claimed in claim 1, wherein said long and said short shafts each of said eccentric shafts include angles totalling 180 degrees.

4. An ascending/descending mechanism as claimed in claim 1, wherein the axial travel of said columns is controlled by deflection of said long and said short shafts each of said eccentric shafts.

5. An ascending/descending mechanism as claimed in claim 1, wherein:

said power source is a wind-up musical bell.

6. An ascending/descending mechanism as claimed in claim 1, wherein:

said base board, said supporting structure and said transmission structure are all made of plastic materials.

* * * * *